United States Patent [19]

Wallace

[11] 4,126,192

[45] Nov. 21, 1978

[54] HYDRAULIC PERCUSSIVE MACHINES

[75] Inventor: Trevor E. Wallace, Bryanston, South Africa

[73] Assignee: The Steel Engineering Company Limited, Roodepoort, South Africa

[21] Appl. No.: 775,993

[22] Filed: Mar. 9, 1977

[30] Foreign Application Priority Data

Mar. 17, 1976 [ZA] South Africa ..... 76/1652

[51] Int. Cl.[2] ..... B25D 9/00

[52] U.S. Cl. ..... 173/105; 173/13

[58] Field of Search ..... 173/105, 106, 107, 108, 173/104, 2, 13; 92/85 B

[56] References Cited

U.S. PATENT DOCUMENTS

| | | | |
|---|---|---|---|
| 3,307,638 | 3/1967 | Kurt | 173/105 |
| 3,741,316 | 6/1973 | Alajouanine | 173/107 |
| 3,866,690 | 2/1975 | Lance et al. | 173/134 |
| 4,006,783 | 2/1977 | Granholm | 173/105 |

*Primary Examiner*—Robert A. Hafer

*Attorney, Agent, or Firm*—Young & Thompson

[57] ABSTRACT

A hydraulic percussive machine comprising a cylinder, a piston reciprocable up and down in the cylinder, an inlet for hydraulic fluid to the machine, an outlet for hydraulic fluid from the machine, valve and timing means for controlling the operation of the piston, a chuck for holding a tool, a mechanism for rotating the chuck, a cushioning flange on the piston, a dashpot space in the cylinder adapted to be entered by the flange on overtravel of the piston on its downstroke, and a first connection for feeding fluid trapped under pressure in the dashpot space to the chuck driving mechanism as a motive for that means.

3 Claims, 1 Drawing Figure

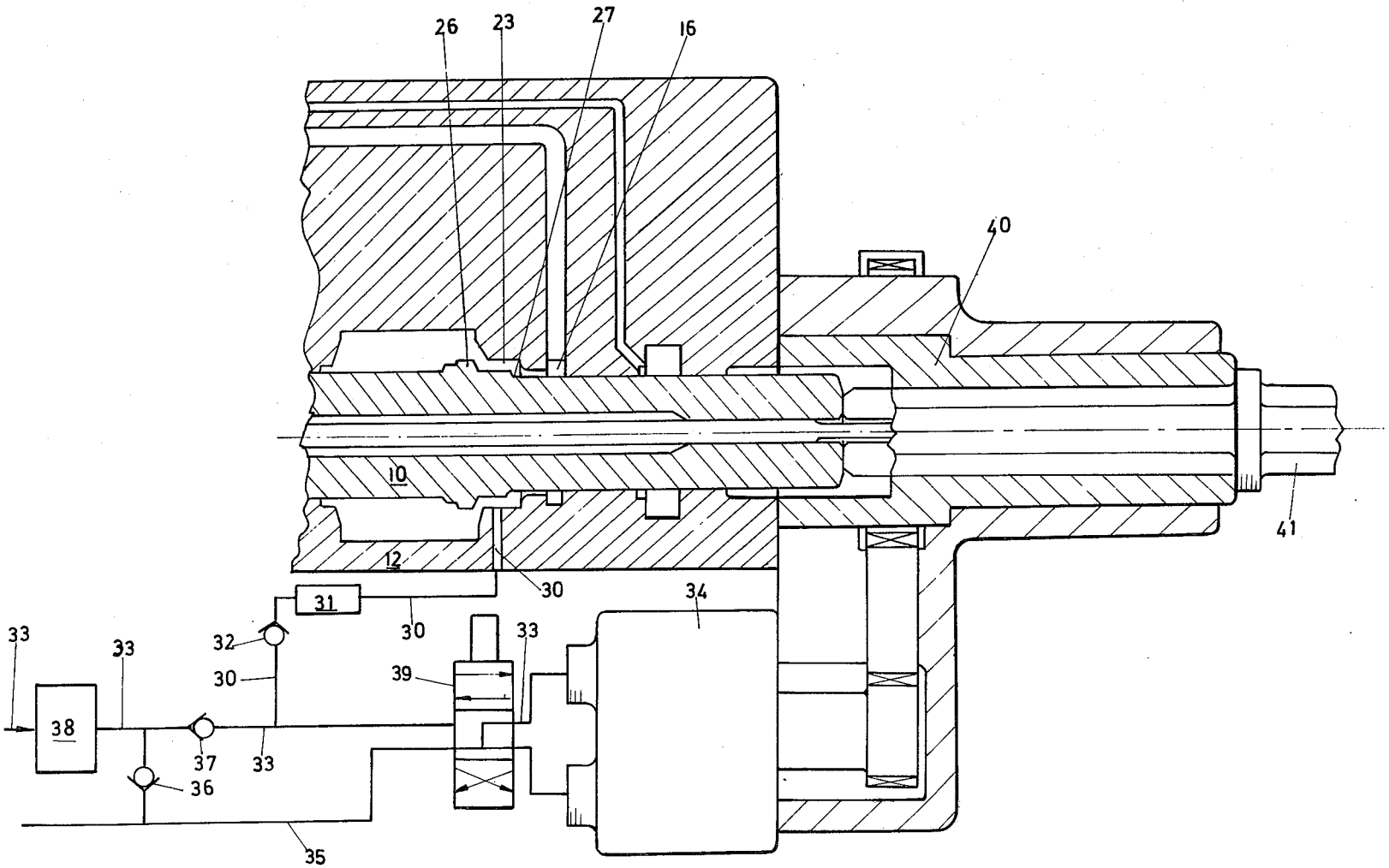
41
40
16
27
23
26
10
12
30
30
31
34
33
39
32
30
33
37
36
35
33
38
33

HYDRAULIC PERCUSSIVE MACHINES

This invention relates to percussive machines in which a tool, such as a rock drill, is chucked to the machine and the tool is struck by a percussion piston driven by hydraulic fluid, while the tool is rotated more or less continuously about its axis.

In hydraulic machines of the kind in question the tool may be rotated in one of two ways. In the first way the reciprocation of the piston is converted into rotary motion by a ratchet mechanism to turn the tool, usually on the non-working stroke of the piston. In the other way a separate hydraulic driver is provided to rotate the tool.

It has also been proposed, see for example the complete specifications of U.S. Pat. No. 3,887,019 and U.S. patent application Ser. No. 775,992, filed Mar. 9, 1977 to provide a cushion space which is entered by a flange on the piston in such a manner as to prevent stalling of the piston under no load conditions.

According to the invention a hydraulic percussive machine comprises a cylinder, a piston reciprocable up and down in the cylinder, an inlet for hydraulic fluid to the machine, an outlet for hydraulic fluid from the machine, valve and timing means for controlling the operation of the piston, a chuck for holding a tool, a mechanism for rotating the chuck, a cushioning flange on the piston, a dashpot space in the cylinder adapted to be entered by the flange on overtravel of the piston on its downstroke, and a first connection for feeding fluid trapped under pressure in the dashpot space to the chuck driving mechanism as a motive fluid for that means.

Thus fluid trapped in a cushion space is used to operate or boost a rotation mechanism adapted to rotate the tool.

In the latter case the rotation mechanism is operated by a pressure fluid circuit by-passing the piston circuit either by being quite independent or by operating as a branch circuit in parallel with the piston circuit, while the cushion space is connected to the rotation mechanism feed through a oneway valve preventing fluid from passing back to the piston circuit.

Even if a rotary motion is obtained from the reciprocation of the piston, the pressure fluid in the cushion space can be used to boost rotation, e.g. by driving the ratchet ring.

In the former case the cushion space is so dimensioned and the piston so designed that fluid is forced out of the cushion space even when the piston is striking the tool, and fluid forced out of the cushion space is fed to a rotation motor circuit to cause rotation of the tool, but this is not a preferred form of the invention.

In all forms of the invention it is preferred that the cushion space be sealed back and front so that the only route from the cushion space, except for unavoidable leakages, is the rotation circuit. This aspect is more closely elaborated in a co-pending application No. 76/1650 by the present applicant.

The invention is further discussed with reference to the accompanying drawing which is a section through part of a rock drill with a schematic hydraulic circuit next to it.

The drawing shows a rock drill of which the relevant parts are a reciprocating piston 10 and a cylinder 12. At its forward end the piston 10 is formed with a cushioning flange 26 which on the power stroke may enter an annular space 23. A shoulder 27 on the piston 10 also enters a forward annular constriction which seals the space 23 from the space 16 which is constantly at the operating pressure of the rock drilling machine.

The volume of the space 23 may be adjusted by varying the various diameters of the parts. The essence is, however, that the space 23 is under a very high pressure on the forward or working stroke of the piston 10 if the piston is allowed to travel to a point where the flange 26 enters the space 23. During normal operation of the illustrated device the flange 26 would not so enter, but if the drilling tool gets stuck and the machine is pulled back to clear the obstructing condition, the flange would so enter. In this regard see the co-pending application referred to above.

Leading from the space 23 is a bore 30 leading to a hydraulic connection which is illustrated schematically and numbered 30. The connection 30 leads firstly to a flow restricting valve 31 and then to a oneway valve 32 preventing back flow of fluid to the space 23. The line 30 joins a line 33 which carries hydraulic fluid for operating a rotation motor 34 of any suitable type. As illustrated the motor could be a gear motor but ratchet motors or piston motors could also be used. Flow to the motor 34 is through a control valve 39 which may be manually operated or be a pilot operated valve. The motor 34 drives a chuck 40 through suitable gearing to rotate a tool 41.

Flow to tank is along the line 35. Between the line 33 and the line 35 is a oneway valve 36 while in the line 33 there is another oneway valve 37 and a flow restricting valve 38.

The valve 39 is illustrated in the neutral position. As illustrated there is a forward position corresponding to the top position as illustrated and a reverse position corresponding to the bottom position as illustrated.

During normal operation with the valve 39 in the forward position hydraulic fluid flows along the line 33 through the valves 38, 37 and 39 to the motor 34 and back to tank through the valve 39 along the line 35. If the motor 34 encounters low load conditions and speeds up due to its own momentum fluid from the line 35 may recirculate through the valve 36 as the pressure in the line 33 drops below tank pressure. Cavitation under these conditions is thus minimized.

Also during normal operating conditions no fluid will flow along the line 30. If the drilling tool encounters sticky conditions and the drilling machine is pulled back, the flange 26 will enter the space 23 and thus pump a quantum of hydraulic fluid under very high pressure to the motor 34 thus giving it a boost. Invariably these boosting pulses will assist in clearing the tool so that normal drilling can be resumed.

I claim:

1. A hydraulic percussive machine comprising a cylinder, a piston reciprocable up and down in the cylinder, an inlet for hydraulic fluid to the machine, an outlet for hydraulic fluid from the machine, means for controlling the operation of the piston, a chuck for holding a tool, a hydraulic mechanism for rotating the chuck, means for leading hydraulic fluid to and from the chuck rotating mechanism, a cushioning flange on the piston, a dashpot space in the cylinder adapted to be entered by the flange on overtravel of the piston at the end of its downstroke, and a first connection for feeding fluid trapped under pressure in the dashpot space to the chuck rotating mechanism, whereby momentum of the piston at the end of its downstroke is converted into rotation of the chuck.

2. The machine claimed in claim 1 including a second connection between the inlet and the chuck driving mechanism and a one-way valve in the first connection preventing flow of fluid back to the space.

3. The machine claimed in claim 1 including an independent hydraulic circuit for the chuck driving mechanism and a one-way valve in the first connection preventing flow of fluid back to the space.

* * * * *